US005606224A

United States Patent [19]

Hua

[11] Patent Number: 5,606,224

[45] Date of Patent: Feb. 25, 1997

[54] PROTECTION CIRCUIT FOR FLUORESCENT LAMPS OPERATING AT FAILURE MODE

[75] Inventor: Jenkin P. Hua, Plainsboro, N.J.

[73] Assignee: Osram Sylvania Inc., Danvers, Mass.

[21] Appl. No.: 561,766

[22] Filed: Nov. 22, 1995

[51] Int. Cl.[6] ..... H05B 37/00

[52] U.S. Cl. ..... 315/121; 315/191; 315/101; 315/127; 315/106; 315/207

[58] Field of Search ..... 315/121, 119, 315/101, 127, 225, 309, 106, 91, DIG. 5, 209 R, 207

[56] References Cited

U.S. PATENT DOCUMENTS

| | | | |
|---|---|---|---|
| 4,039,895 | 8/1977 | Chermin et al. | 315/101 |
| 4,066,932 | 1/1978 | Rottier | 315/244 |
| 4,177,403 | 12/1979 | Remery | 315/101 |
| 4,398,126 | 8/1983 | Zuchtriegel | 315/127 |
| 4,447,763 | 5/1984 | Iyama et al. | 315/207 |
| 4,810,936 | 3/1989 | Nuckolls et al. | 315/119 |
| 4,928,039 | 5/1990 | Nilssen | 315/209 R |
| 4,970,438 | 11/1990 | Nilssen | 315/DIG. 5 |
| 5,051,661 | 9/1991 | Lee | 315/225 |
| 5,111,114 | 5/1992 | Wang | 315/225 |
| 5,321,337 | 6/1994 | Hsu | 315/219 |
| 5,363,017 | 11/1994 | Garbowicz | 315/122 |
| 5,475,284 | 12/1995 | Lester et al. | 315/209 R |

*Primary Examiner*—Robert Pascal
*Assistant Examiner*—Haissa Philogene
*Attorney, Agent, or Firm*—Carlo S. Bessone

[57] ABSTRACT

A circuit for protecting fluorescent lamps connected to high frequency electronic ballasts has a detecting bridge connected to the fluorescent lamps, an output of the detecting bridge varying linearly with the highest voltage across the fluorescent lamps, a number of shunt capacitors equal to the number of fluorescent lamps, each shunt capacitor being connected between the detecting bridge and a corresponding fluorescent lamp, a timer connected to the detecting bridge output, a trigger connected to an output of the timer, the trigger being responsive to an over-voltage condition of a fluorescent lamp operating at failure mode, and a controllable switch connected across the fluorescent lamps, the controllable switch being controlled by an output of the trigger. The controllable switch, when closed, couples the shunt capacitors across the terminals of a corresponding fluorescent lamp and shuts down the fluorescent lamp which is operating at failure mode or at the end of its operating life. This causes the fluorescent lamp or lamps operating at failure mode or at the end of its operating life to be individually shut down, without affecting the operation of the remaining fluorescent lamps.

12 Claims, 3 Drawing Sheets

PROTECTION CIRCUIT FOR FLUORESCENT LAMPS OPERATING AT FAILURE MODE

FIELD OF THE INVENTION

The present invention relates to the field of fluorescent lamps, and more particularly to the protection of fluorescent lamps utilizing high frequency ballasts.

BACKGROUND OF THE INVENTION

When a fluorescent lamp is operating at failure mode or reaches the end of its operating life, the power of the lamp ballast may increase to abnormally high levels. In some cases, the lamp becomes so hot as to cause the glass wall of the lamp to crack. It is thus necessary to employ a protection circuit to protect the rest of the circuit from the over-voltage conditions that may appear under these operating conditions.

It is presently known to protect arrays of parallel-connected fluorescent lamps by circuits which sense an over-voltage condition and interrupt the fluorescent lamps' power supply upon sensing an overvoltage condition that could damage or destroy the lamps.

An example of such a circuit is described in U.S. Pat. No. 4,398,126, in which a thyristor control circuit controls the firing of a thyristor to ground the base electrode of a transistor when an over-voltage condition is sensed. The transistor, when its base is grounded, de-energizes an oscillatory circuit which powers the fluorescent lamps, thus turning them off. This patent also describes a timer circuit which inhibits the firing of the thyristor during the igniting phase of the lamps.

Another similar example can be found in U.S. Pat. No. 5,321,337, in which a base electrode of a transistor which controls the oscillation of the circuit is grounded by a thyristor upon detection of excess voltage. In this circuit, a capacitor is charged by a coupling winding of a protection circuit, which, in turn, triggers a diac that activates the thyristor controlling the base of the transistor. Once the oscillation transistor is in its non-conductive state, it is prevented from oscillating and from supplying excessive voltage to the fluorescent lamps.

A further example of this approach is seen in U.S. Pat. No. 4,928,039, in which a sensing varistor limits over-voltages by charging a capacitor to a negative voltage, which removes base current from a transistor. This stops the oscillation of the transistor, and prevents the fluorescent lamps from being damaged by the over-voltage.

A still further example of this approach is described in U.S. Pat. No. 5,051,661, in which a heat sensing element triggers a thyristor in response to an abnormal voltage or in response to an overheated condition. The heat sensitive element is, in this example a bimetal switch. In the circuit described in this patent, the heat sensitive element triggers the thyristor to render a transistor conductive which, in turn, shorts out the primary winding of a transformer whose secondary windings are coupled to the bases of oscillation transistors. When the oscillation transistors are turned off, the fluorescent lamps are held in an off state.

Another example can be found in U.S. Pat. No. 5,111,114. In this reference, the generation of high amplitude, high frequency voltages which can damage the fluorescent lamps is prevented by turning the oscillation transistors off. This is accomplished by discharging a diac-driving capacitor which triggers one of the oscillating transistors. Once this capacitor is discharged, it is no longer capable of driving the transistor, and prevents the generation of harmful over-voltages and the supply of these over-voltages to the fluorescent lamps.

It is also known to apply a short circuit across a pair of malfunctioning lamps, to thereby prevent their operation. An example of this approach is described in U.S. Pat. No. 4,970,438, in which a varistor causes a capacitor to charge. When the voltage across the capacitor is high enough, it causes the breakdown of a diac which triggers a thyristor. When the thyristor is triggered, an effective short circuit is placed across the varistor and also across the malfunctioning pair of lamps. This prevents excessive power drain from the inverter and damage to the varistor.

As an alternative to shorting out malfunctioning pairs of fluorescent lamps, it is also known to open a switch connecting the fluorescent lamps to their power supply upon detection of an over- voltage using a diode-thyristor combination. This is shown in, for example, U.S. Pat. No. 4,810,936.

Also of interest is U.S. Pat. No. 5,363,017, in which starting capacitors, which shunt the fluorescent lamps upon start-up, are removed from the ballast upon ignition of all fluorescent lamps.

It is also known, as described in U.S. Pat. No. 4,177,403, to limit the igniting current to a low value when the fluorescent lamps fail to ignite. By coupling a temperature sensitive element to an inductor in series with the lamp ballast, the ballast current can be limited, so as to prevent damage to the lamps.

The above-described circuits, however, upon detecting an over-voltage condition, either short out or disconnect the oscillating circuit supplying the fluorescent lamps. This shuts off not only the malfunctioning lamp, but also shuts off a number of other lamps which are not operating at failure mode. This, of course, is a less than optimal condition.

There exists, therefore, a need for a protection circuit for use with a plurality of lamps, which is capable of identifying one or more failing or failed lamp, and capable of shutting down each failing or failed lamp while keeping the rest of the lamps operating at a normal power level.

SUMMARY OF THE INVENTION

It is, therefore, an object of the present invention to provide a protection circuit, for a plurality of fluorescent lamps, which is capable of identifying and shutting down any fluorescent lamp which is operating at failure mode or has reached the end of its operating life, while keeping the remaining lamps operating at normal power levels.

It is another object of the present invention to provide a protection circuit which disables a malfunctioning fluorescent lamp without shutting down its high frequency electronic ballast.

These objects are accomplished in one aspect of the invention by the provision of a protection circuit for protecting a plurality of fluorescent lamps connected to a ballast. Each fluorescent lamp includes a first and second terminal, each second terminal being connected to a common voltage. The protection circuit includes a detecting bridge connected to the fluorescent lamps, an output of the detecting bridge varying linearly with the highest voltage across one of a plurality of fluorescent lamps. The number of shunt capacitors is equal to the number of fluorescent lamps, each shunt capacitor being connected between the detecting bridge and the first terminal of a corresponding fluorescent lamp. A timer is connected to the detecting bridge output, and a trigger connected to an output of the timer, the trigger being responsive to an over-voltage condition of a fluorescent lamp operating at failure mode. A controllable switch is connected across the fluorescent lamps, the controllable switch being controlled by an output of the trigger. The controllable switch, when closed, couples the shunt capacitors across the first and second terminals of a plurality of lamps. The voltage of the shunt capacitor is higher than that of a normal operating lamp and lower than that of the lamp which is operating at failure mode or has reached the end of its operating life. This causes the fluorescent lamp operating at failure mode or having reached the end of its operating life to be individually shut down, without affecting the operation of the remaining fluorescent lamps.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention may be clearly understood by reference to the attached drawings, wherein like elements are designated by like reference elements and in which.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
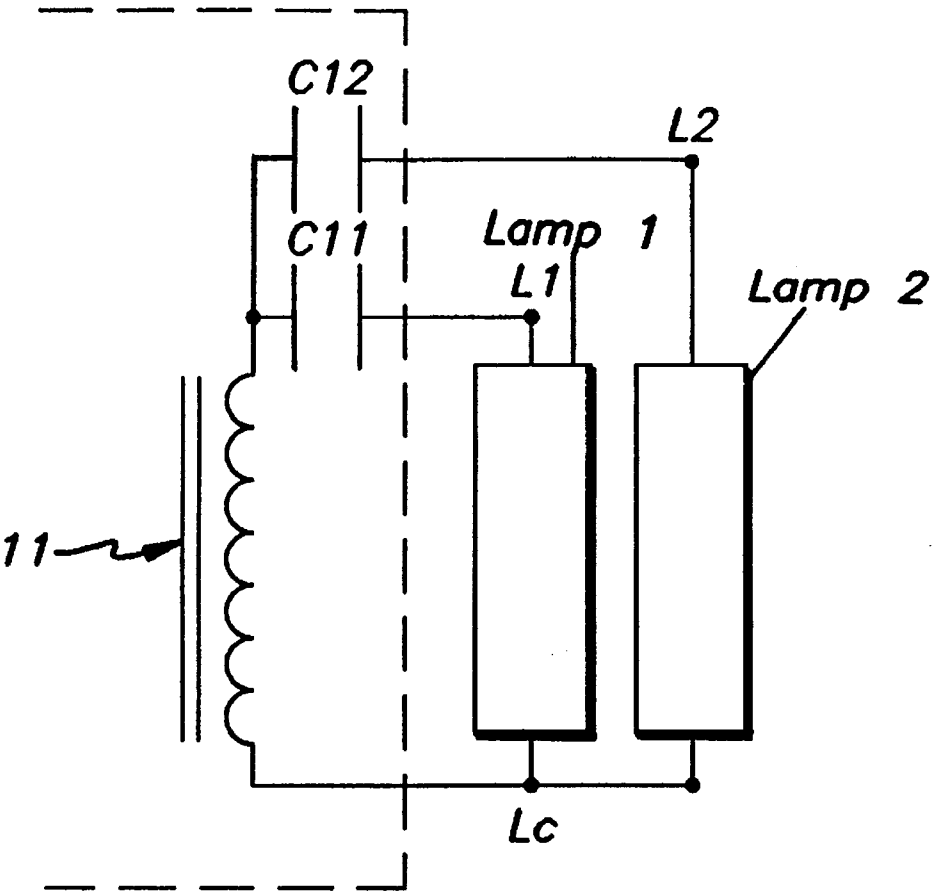
FIG. 1 Prior Art
FIG. 1 is a circuit diagram of a conventional ballast circuit connected to a pair of fluorescent lamps.

FIG. 1 shows an example of a conventional circuit for supplying two fluorescent lamps to which the circuit according to the present invention may be applied. Reference numeral 11 refers to a high frequency electronic ballast output circuit. C11 and C12 are ballasting elements connected to terminal L1 of lamp 1 and terminal L2 of lamp 2, respectively. The other terminals Lc of lamp 1 and lamp 2 are each connected, via a common lead, to a common voltage at the ballast output circuit 11.

Figure 2:
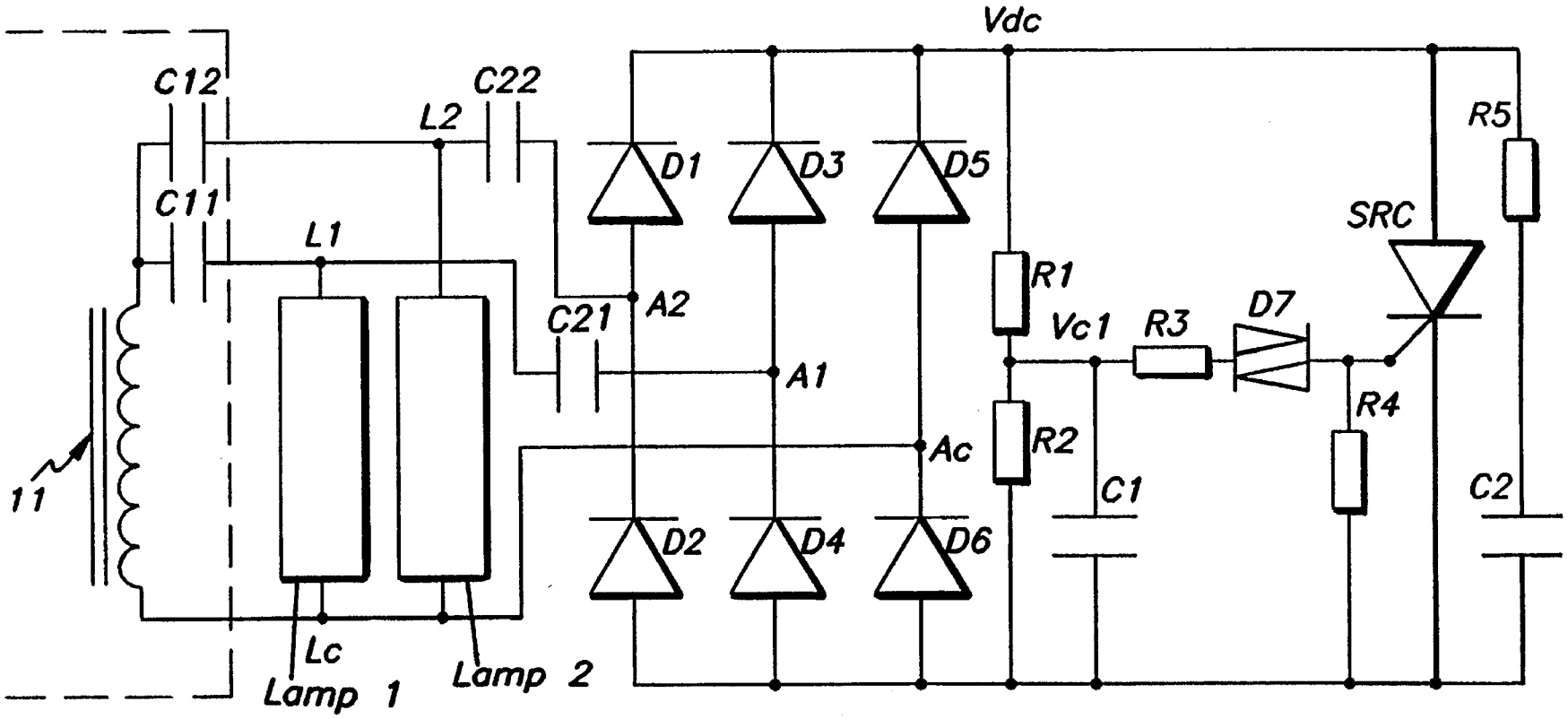
FIG. 2 is a circuit diagram of a protection circuit for protecting two fluorescent lamps according to an embodiment of the present invention.

FIG. 2 shows a protection circuit of the present invention connected to a two lamp circuit of the type depicted in FIG. 1. Lamp 1 and lamp 2 are connected in parallel to the ballast output circuit 11 in parallel. Terminals L1 and L2 are serially connected to shunt capacitors C21 and C22, respectively. The shunt capacitors C21 and C22 are connected to the inputs of a detecting bridge. The shunt capacitors are chosen such that they only charge to a voltage whose magnitude is higher than an operating voltage of the fluorescent lamps. The detecting bridge is composed of pairs of nonlinear elements connected in series, the pairs of nonlinear elements being connected to each other in parallel. Nodes A2 and A1 between respective pairs of the nonlinear elements are connected to corresponding shunt capacitors C22 and C21, respectively. Node Ac between the remaining pair of nonlinear elements is connected to the common voltage at the node Lc. The nonlinear elements of the detecting bridge are chosen such that they are conductive when forward biased with a voltage corresponding to a voltage generated by a fluorescent lamp operating at failure mode, or operating at the end of its operating life. In FIG. 2, the nonlinear elements are shown to be, for purposes of illustration, respective pairs of diodes D1 and D2; D3 and D4; and D5 and D6. However, the skilled artisan will readily recognize that other elements exhibiting non-linear characteristics may be chosen, such as, for example, diode-connected transistors.

A voltage divider circuit including, for example, a resistive circuit formed by resistors R1 and R2 is connected across the output of the detecting bridge. The voltage at the output of the detecting bridge is labeled as Vdc in FIG. 2. Since the output voltage Vdc at the output of the detecting bridge is linear to the maximum lamp voltage among the lamps, the output voltage Vdc can be used as a control signal indicative of the operation mode of the lamps.

The output voltage Vdc is then divided by the voltage divider of R1 and R2 to produce a voltage Vc1 across a timing capacitor C1 at the output of the voltage divider. The voltage Vc1 is, then:

$$Vc1=Vdc\times R2/(R1+R2),$$

wherein

Vdc is the output voltage;

R1 is the resistance value of resistor R1; and

R2 is the resistance value of resistor R2.

The timing capacitor C1 connected across Vc1, and the resistive circuit of R1 and R2, constitute a timer whose time constant Tc is chosen to be greater than an ignition time of fluorescent lamps not operating at failure mode, and is defined by:

$$Tc=C1\times R1\times R2/(R1+R2),$$

wherein

C1 is the capacitance value of timing capacitor C1;

R1 is the resistance value of resistor R1; and

R2 is the resistance value of resistor R2.

The time constant Tc is, therefore, chosen such that the protection circuit according to the present invention is not triggered by the high voltages normally present during the ignition phase of fluorescent lamps.

A resistor R3 is connected between the output of the voltage divider and a trigger D7. Trigger D7 is used to trigger switch SCR, and may be, for example, a bi-directional diode such as a diac. The trigger D7 is responsive to an over-voltage condition of a fluorescent lamp operating at failure mode or at the end of its operating life. The switch SCR is, for example, a silicon-controlled-rectifier, and is connected across the output of the detecting bridge. A resistor R4 is connected between the output of the trigger D7 and the switch SCR. Finally, an output voltage smoothing and current limiting circuit is connected across the switch SCR to smooth the voltage across the detecting bridge and to limit the current through the switch SCR. In FIG. 2, the output voltage smoothing and current limiting circuit is illustrated as comprising a resistor R5 and a series capacitor C2, the series connected pair being connected across the output of the detecting bridge. However, any smoothing and attenuating filter may be employed, as those of skill in this art will readily recognize.

The following will detail the operation of the circuit illustrated in FIG. 2. During a normal operation of the fluorescent lamps, the voltage of the lamps is normal and the output voltage of the detecting bridge is the normal lamp voltage. The voltage of the capacitor C1, Vc1 is lower than the trigger voltage of trigger D7. Switch SCR is in an off state and the whole system assumes a normal operating state.

If, for example, lamp i has failed, the voltage of lamp 1 goes high, and the detecting bridge detects the voltage of lamp 1. The output voltage Vdc goes high and charges timing capacitor C1. When the voltage of timing capacitor C1 is higher than the trigger voltage of trigger D7, D7 is triggered and switch SCR is turned on. When the switch SCR is turned on, the terminals A1 and A2 are shorted to the terminal Lc and capacitors C21, C22 are separately connected to lamp 1 and lamp 2 in parallel. Since the voltage of shunt capacitor C21 is designed to be lower than the failure mode voltage of lamp 1, lamp 1 is shut down. Thus, the present invention shuts down the fluorescent lamp(s) operating at failure mode, while maintaining the operation of those fluorescent lamps not operating at failure mode.

Figure 3:
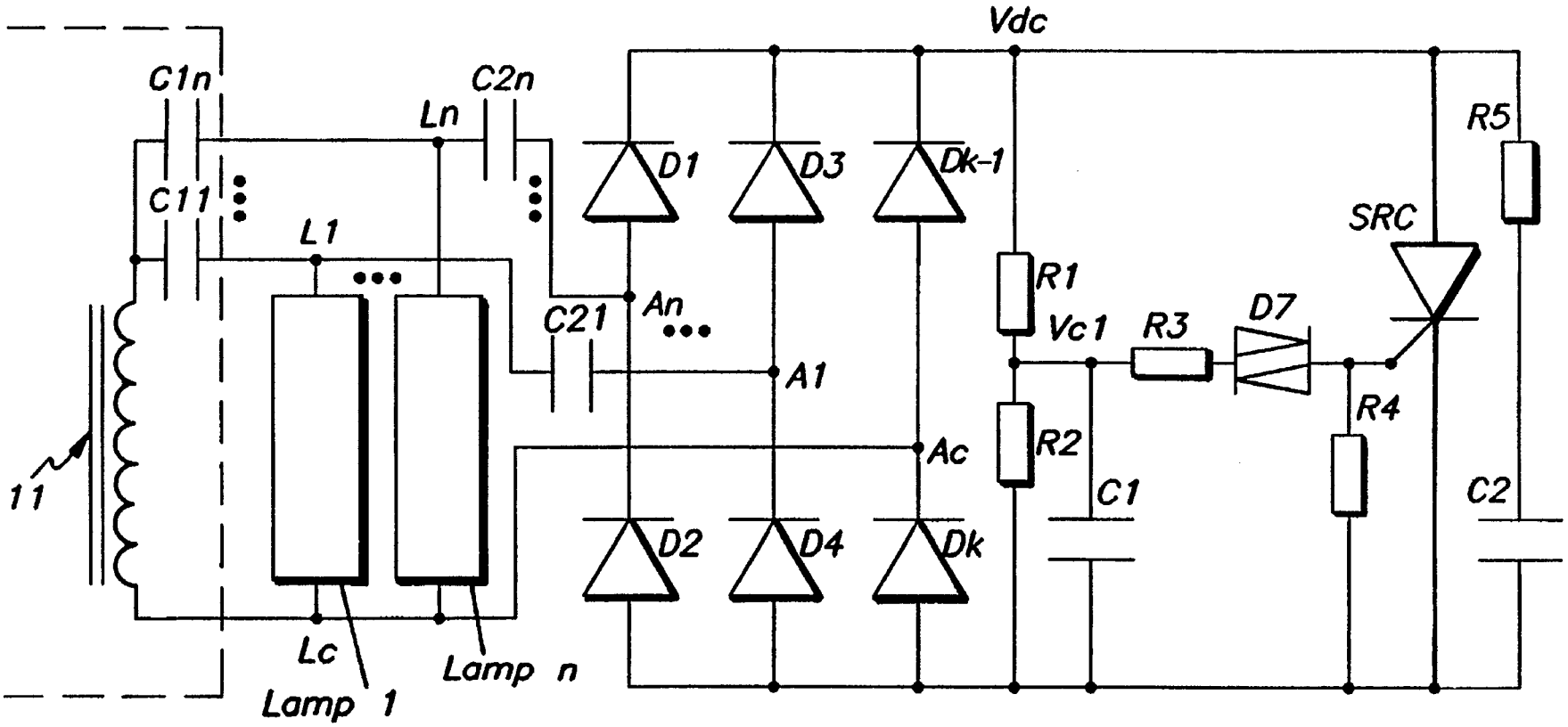
FIG. 3 is a circuit diagram for a protection circuit for protecting n fluorescent lamps according to a second embodiment of the present invention.

FIG. 3 depicts a further embodiment of the present invention. Here, instead of protecting two fluorescent lamps, as in FIG. 2, a protection circuit for n lamps is shown. To avoid repetition, the description of the structure of the circuit of FIG. 2 is omitted where this structure is identical with the structure of the first embodiment. In this embodiment, the protection circuit is provided with n shunt capacitors C21 to C2n, each connected to a respective lamp I to lamp n. The detecting bridge, in FIG. 3, is constituted by k nonlinear elements, referenced by D1 to Dk. Each pair of nonlinear elements is connected to a respective shunt capacitor C21 to C2n at nodes A1 to An, respectively. The last pair of nonlinear elements Dk-1, Dk is connected to the common voltage at the node Lc. In the embodiment of FIG. 3, when switch SCR turns on, n shunt capacitors C21 to C2n are connected across n lamps lamp i to lamp n. The circuit shuts down the failed lamp or the failed lamps and keeps the remaining lamps running. In this embodiment, it is understood that n is any integer number greater than zero.

The embodiments which have been described herein are but some of several which utilize this invention and are set forth here by way of illustration but not of limitation. It is apparent that many other embodiments which will be readily apparent to those skilled in the art may be made without departing materially from the spirit and scope of the invention.

What is claimed is:

1. A protection circuit for protecting a plurality of fluorescent lamps connected to a ballast, each fluorescent lamp of said plurality of fluorescent lamps having a first and second terminal, said-second terminal of each fluorescent lamp being connected to a common voltage, comprising:

a detecting bridge connected to said plurality of fluorescent lamps, an output of said detecting bridge varying linearly with the highest voltage among said plurality of fluorescent lamps;

a plurality of shunt capacitors, in number equal to a number of said fluorescent lamps, each shunt capacitor of said plurality of shunt capacitors being connected between said detecting bridge and said first terminal of a corresponding fluorescent lamp;

a timer connected to said detecting bridge output;

a trigger connected to an output of said timer, said trigger being responsive to an over-voltage condition of a fluorescent lamp operating at failure mode; and a controllable switch connected across said plurality of fluorescent lamps, said controllable switch being controlled by an output of said trigger, said controllable switch, when closed, coupling each of said plurality shunt capacitors across said first and second terminals of a corresponding fluorescent lamp, when said corresponding fluorescent lamp is operating at failure mode, whereby said corresponding fluorescent lamp operating at failure mode or at the end of its operating life is individually shut down.

2. Protection circuit according to claim 1, wherein said detecting bridge comprises a plurality of pairs of nonlinear elements connected in series, said plurality of pairs being connected in parallel, a node between nonlinear elements of all but one pair of said plurality of pairs of nonlinear elements being connected to a corresponding shunt capacitor of said plurality of shunt capacitors, a node between nonlinear elements of said one pair being connected to said common voltage.

3. Protection circuit according to claim 2, wherein each nonlinear element of said plurality of pairs of nonlinear elements is conductive when forward biased with a voltage corresponding to a voltage generated by a fluorescent lamp operating at failure mode or at the end of its operating life.

4. Protection circuit according to claim 2, wherein each nonlinear element of said plurality of pairs of nonlinear elements comprises a diode.

5. Protection circuit according to claim 2, wherein each nonlinear element of said plurality of pairs of nonlinear elements comprises a diode-connected transistor.

6. Protection circuit according to claim 1, wherein said timer comprises a voltage divider circuit connected across said output of said detecting bridge, an output of said voltage divider circuit being connected to a timing capacitor, said timer having a time constant greater than an ignition time of fluorescent lamps not operating at failure mode or at the end of its operating life.

7. Protection circuit according to claim 6, wherein said voltage divider circuit comprises a resistive circuit.

8. Protection circuit according to claim 1, wherein said trigger comprises a bi-directional diode which is conductive when said timing capacitor charges to a voltage exceeding a threshold voltage of said bi-directional diode.

9. Protection circuit according to claim 1, wherein said controllable switch is a silicon-controlled rectifier having a control electrode connected to said output of said trigger.

10. Protection circuit according to claim 1, further comprising an output voltage smoothing and current limiting circuit connected across said controllable switch, to thereby smooth the voltage across said detecting bridge and limit a current through said controllable switch.

11. Protection circuit according to claim 10, wherein said output voltage smoothing and current limiting circuit comprises an output resistor and an output capacitor connected in series.

12. Protection circuit according to claim 1, wherein each shunt capacitor of said plurality of shunt capacitors only charges to a voltage whose magnitude is smaller than an operating voltage of said plurality of fluorescent lamps.

* * * * *